US009731930B2

(12) United States Patent
Nobe

(10) Patent No.: US 9,731,930 B2
(45) Date of Patent: Aug. 15, 2017

(54) SHEET PROCESSING APPARATUS AND IMAGE FORMING SYSTEM

(71) Applicant: FUJI XEROX CO., LTD., Minato-ku, Tokyo (JP)

(72) Inventor: Yutaka Nobe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 159 days.

(21) Appl. No.: 14/844,735

(22) Filed: Sep. 3, 2015

(65) Prior Publication Data

US 2016/0280502 A1 Sep. 29, 2016

(30) Foreign Application Priority Data

Mar. 27, 2015 (JP) ..... 2015-067002

(51) Int. Cl.
*B65H 45/12* (2006.01)
*B65H 45/30* (2006.01)
(Continued)

(52) U.S. Cl.
CPC ..... *B65H 45/12* (2013.01); *B31F 1/0035* (2013.01); *B65H 45/18* (2013.01); *B65H 45/30* (2013.01);
(Continued)

(58) Field of Classification Search
CPC ..... B31F 1/0035; B65H 45/12; B65H 45/30; B65H 2801/27; B65H 2701/13212; B65H 2301/51232
(Continued)

(56) References Cited

U.S. PATENT DOCUMENTS 7,631,858 B2 * 12/2009 Harada ..... B42C 3/00 270/32
8,191,882 B2 * 6/2012 Kikkawa ..... B65H 45/18 270/32
(Continued)

FOREIGN PATENT DOCUMENTS

JP 2009-208849 A 9/2009
JP 2011-251811 A 12/2011

OTHER PUBLICATIONS

Communication dated Jan. 19, 2016 from the Japanese Patent Office issued in corresponding Application No. 2015-067002.

*Primary Examiner* — Leslie A Nicholson, III
(74) *Attorney, Agent, or Firm* — Sughrue Mion, PLLC

(57) ABSTRACT

A sheet processing apparatus includes two pressing members and an advancing-receding unit. The pressing members nip and press against a fold section of a sheet. The advancing-receding unit causes the pressing members to repeatedly press against the fold section by causing at least one of the pressing members to advance to and recede from the other pressing member. The advancing-receding unit varies a reception separation amount and a post-receding separation amount from each other and sets the post-receding separation amount to be smaller than the reception separation amount. The reception separation amount is a separation amount by which the pressing members are separated from each other when the fold section is to be received between the pressing members. The post-receding separation amount is a separation amount by which the pressing members that have pressed against the fold section are separated from each other after receding from the fold section.

7 Claims, 12 Drawing Sheets

(51) Int. Cl.
*B31F 1/00* (2006.01)
*B65H 45/18* (2006.01)

(52) U.S. Cl.
CPC ..... *B65H 2301/51232* (2013.01); *B65H 2402/31* (2013.01); *B65H 2403/512* (2013.01); *B65H 2511/10* (2013.01); *B65H 2511/22* (2013.01); *B65H 2511/30* (2013.01); *B65H 2515/112* (2013.01); *B65H 2701/13212* (2013.01); *B65H 2801/27* (2013.01)

(58) Field of Classification Search
USPC ..... 193/406
See application file for complete search history.

(56) References Cited

U.S. PATENT DOCUMENTS

| | | | | |
|---|---|---|---|---|
| 8,240,654 | B2 * | 8/2012 | Asami | G03G 15/6538 270/32 |
| 8,256,758 | B2 * | 9/2012 | Kobayashi | B65H 45/18 270/32 |
| 8,474,807 | B2 * | 7/2013 | Asami | B42C 7/004 270/37 |
| 2007/0120310 | A1 * | 5/2007 | Awano | B42C 5/02 270/45 |
| 2011/0103863 | A1 * | 5/2011 | Asami | B42C 7/004 399/407 |
| 2011/0241274 | A1 * | 10/2011 | Iijima | B65H 45/18 270/37 |
| 2011/0301009 | A1 | 12/2011 | Hattori et al. | |

* cited by examiner 37
37A
37B
L1
D11
D12
D13
D14
X1

TIME IS SHORTENED 37
37A
37B
L2
D21
D22
D23
D24
X1
X2
X3
X4
X1 = 10 mm
X2 = 5 mm
X3 = 2 mm
X4 = 0.5 mm

SHEET PROCESSING APPARATUS AND IMAGE FORMING SYSTEM

CROSS-REFERENCE TO RELATED APPLICATIONS

This application is based on and claims priority under 35 USC 119 from Japanese Patent Application No. 2015-067002 filed Mar. 27, 2015.

BACKGROUND

Technical Field

The present invention relates to sheet processing apparatuses and image forming systems.

Summary

According to an aspect of the invention, there is provided a sheet processing apparatus including a pair of pressing members that nip and press against a fold section of a sheet and an advancing-receding unit that causes the pair of pressing members to repeatedly press against the fold section by causing at least a first pressing member of the pair of pressing members to advance to and recede from a second pressing member of the pair of pressing members. The advancing-receding unit varies a reception separation amount and a post-receding separation amount from each other and sets the post-receding separation amount to be smaller than the reception separation amount. The reception separation amount is a separation amount by which the two pressing members are separated from each other when the fold section is to be received between the pair of pressing members. The post-receding separation amount is a separation amount by which the two pressing members that have pressed against the fold section are separated from each other after receding from the fold section.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the appended drawings.

Image Forming System 100

Figure 1:
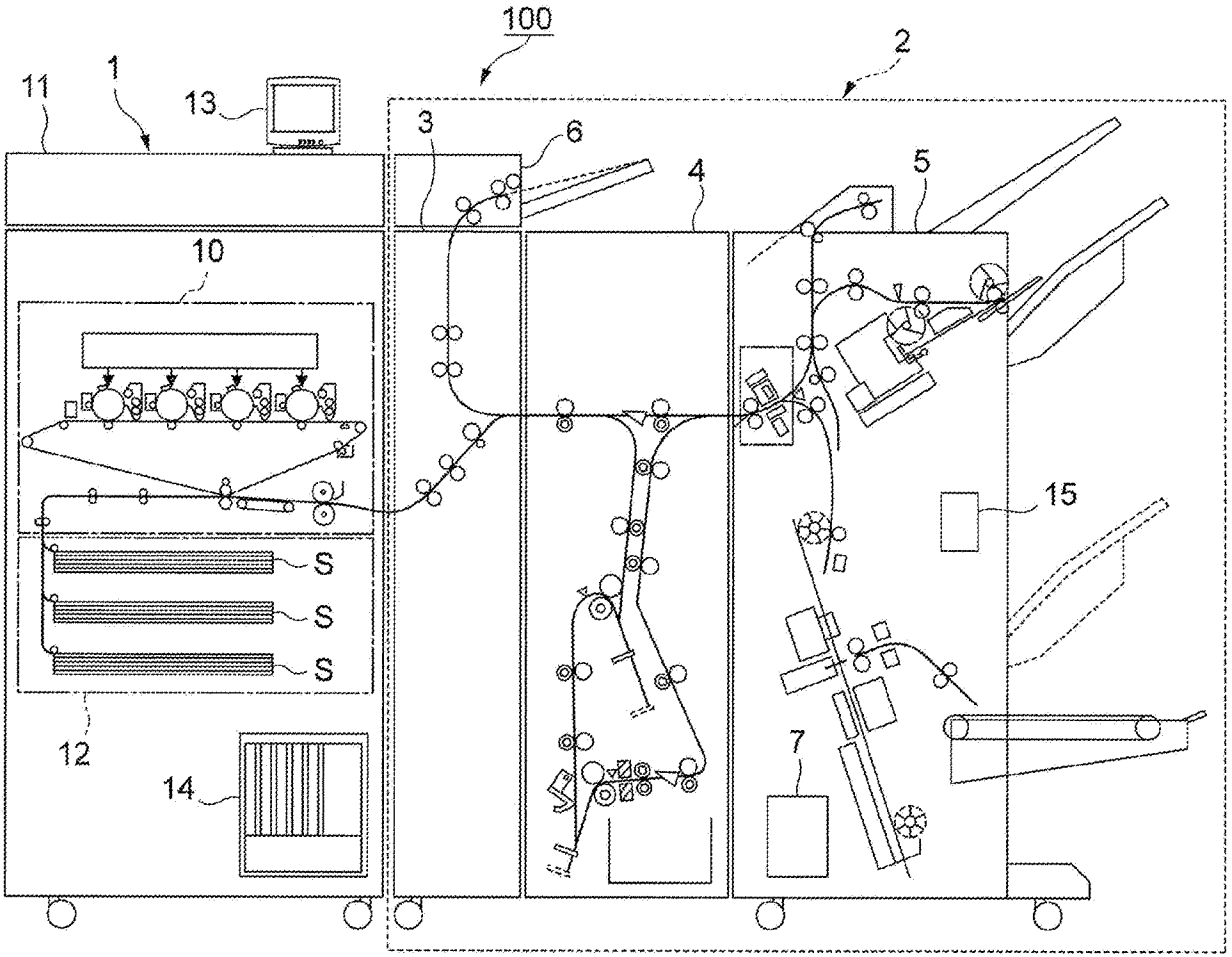
FIG. 1 illustrates the overall configuration of an image forming system according to an exemplary embodiment.

FIG. 1 illustrates the overall configuration of an image forming system 100 according to this exemplary embodiment. The image forming system 100 shown in FIG. 1 includes an image forming apparatus 1, such as a printer or a copier, which forms a color image by, for example, electrophotography, and a post-processing apparatus 2 that performs post-processing on a sheet S having an image formed thereon by the image forming apparatus 1.

The image forming apparatus 1 includes an image forming unit 10 that forms an image based on color image data, an image reading unit 11 that generates read image data by reading an image from a document, a sheet feed unit 12 that feeds a sheet S to the image forming unit 10, an overall user interface 13 that receives an operation input from a user and presents information to the user, and a controller 14 that controls the overall operation of the image forming system 100.

The post-processing apparatus 2 is provided with a transport unit 3 that receives and transports the sheet S having the image formed thereon from the image forming apparatus 1, a folding unit 4 that performs a folding process on the sheet S transported from the transport unit 3, a finisher unit 5 that performs a finishing process on the sheet S that has passed through the folding unit 4, and an interposer 6 that supplies a slip sheet to be used as, for example, a booklet cover.

Furthermore, the post-processing apparatus 2 is provided with a sheet processing controller 7 that controls each functional unit of the post-processing apparatus 2, and a user interface (UI) 15 that receives a post-processing-related operation input from the user.

Although a configuration example in which the sheet processing controller 7 is provided within the post-processing apparatus 2 is described in this exemplary embodiment, the sheet processing controller 7 may alternatively be provided within the image forming apparatus 1. Moreover, the controller 14 may alternatively have the control function of the sheet processing controller 7.

Furthermore, although a configuration example in which the user interface 15 is provided in the post-processing apparatus 2 is described in this exemplary embodiment, the user interface 15 may alternatively be provided in the image forming apparatus 1. Moreover, the overall user interface 13 may have the function of the user interface 15.

Post-Processing Apparatus 2

Figure 2:
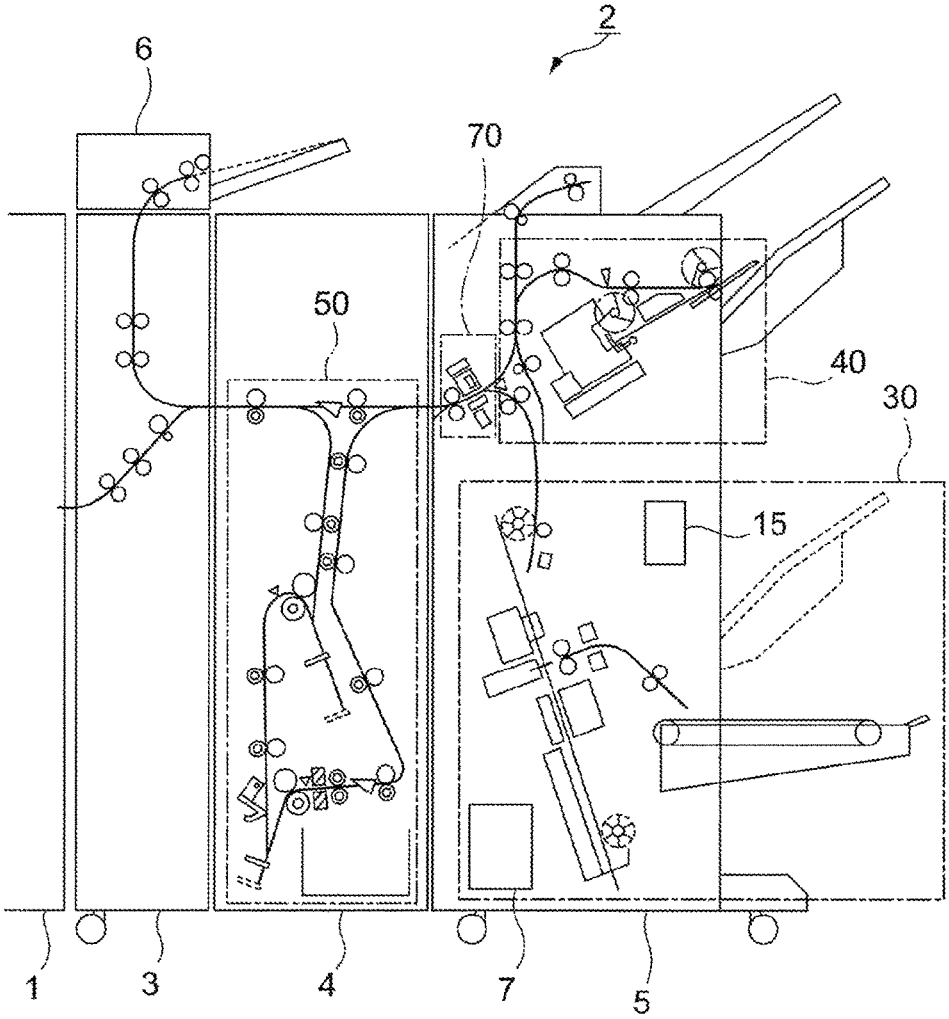
FIG. 2 illustrates a post-processing apparatus.

FIG. 2 illustrates the post-processing apparatus 2. The post-processing apparatus 2 is provided with the finisher unit 5. The finisher unit 5 is provided with a punching functional unit 70 that performs a hole-punching process on a sheet S so as to form, for example, two holes or four holes therein, and an edge-binding functional unit 40 that creates a sheet bundle by stacking a predetermined number of sheets S and performs a stapling process (i.e., an edge-binding process) on an edge of this sheet bundle.

The post-processing apparatus 2 is also provided with a saddle-stitch bookbinding functional unit 30 that creates a sheet bundle by stacking a predetermined number of sheets S and that forms a booklet (i.e., performs a bookbinding process) by performing a binding process (i.e., a saddle-stitching process) on a central area of this sheet bundle.

Moreover, the folding unit 4 in the post-processing apparatus 2 is provided with a folding functional unit 50 that performs a folding process, such as an inward threefold process (i.e., a C-fold process) or an outward threefold process (i.e., a Z-fold process), on a sheet S.

Saddle-Stitch Bookbinding Functional Unit 30

Figure 3:
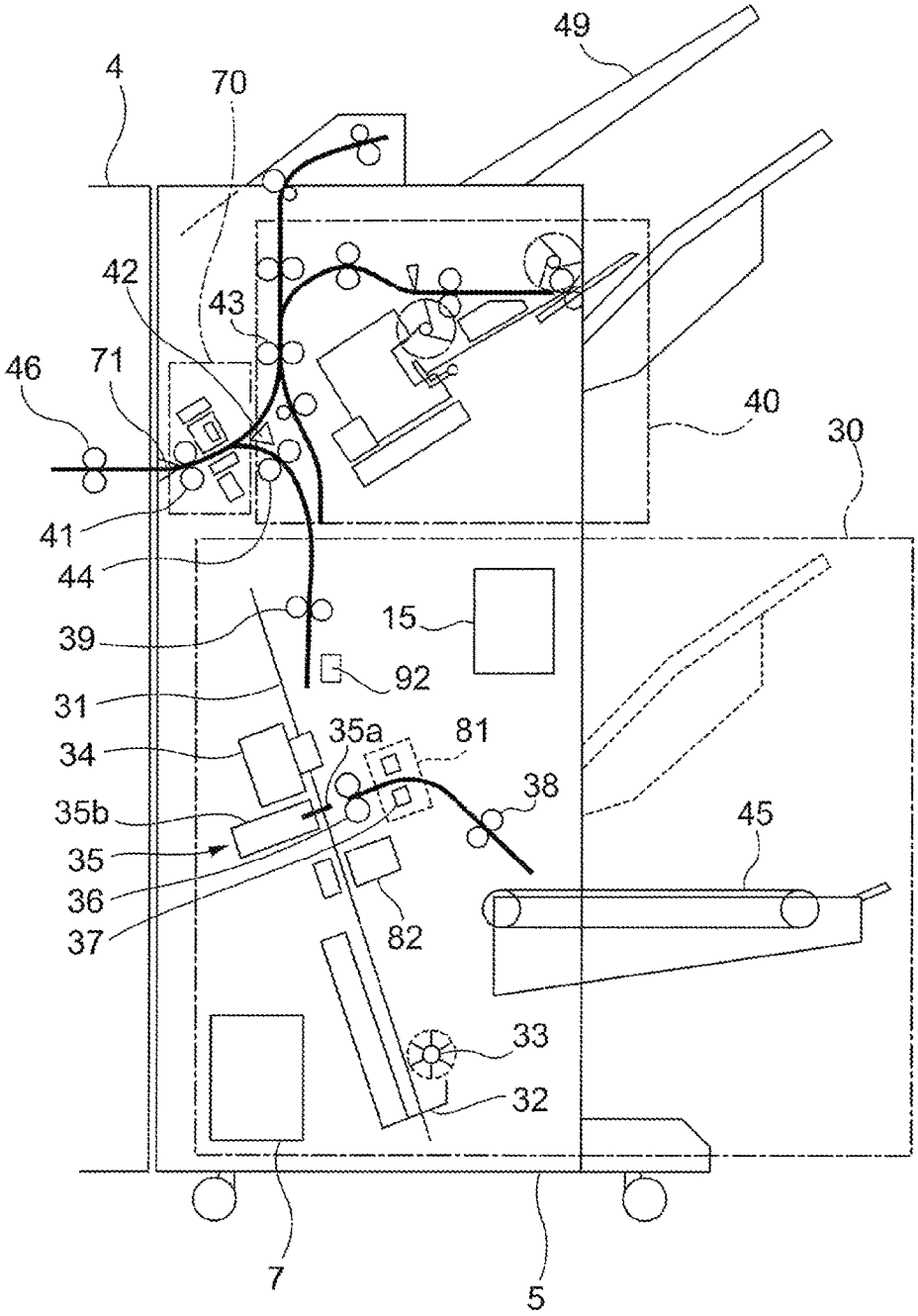
FIG. 3 illustrates the configuration of a saddle-stitch bookbinding functional unit.

FIG. 3 illustrates the configuration of the saddle-stitch bookbinding functional unit 30.

The saddle-stitch bookbinding functional unit 30 is provided with a plate-shaped compiling member 31 that forms a sheet bundle by stacking a predetermined number of sheets S after an image forming process. The saddle-stitch bookbinding functional unit 30 is also provided with a transport roller 39 that transports sheets S one-by-one to the compiling member 31. Moreover, the saddle-stitch bookbinding functional unit 30 is provided with an end guide 32 that supports the sheet bundle on the compiling member 31 from below. This end guide 32 is movable along the compiling member 31.

Furthermore, the saddle-stitch bookbinding functional unit 30 is provided with a sheet alignment paddle 33 that aligns the edges of sheets S by biasing the sheets S stacked on the compiling member 31 toward the end guide 32, and a sheet-width alignment member 34 that aligns the sheets S in the width direction of the sheets S stacked on the compiling member 31. Moreover, the saddle-stitch bookbinding functional unit 30 is provided with a stapler 82 that performs a binding process on the sheet bundle on the compiling member 31 by piercing a staple (not shown) therethrough.

Furthermore, the saddle-stitch bookbinding functional unit 30 is provided with a folding-process mechanism 35 that performs a folding process on the sheet bundle that has undergone the binding process.

The folding-process mechanism 35 is provided with a folder knife 35*a*. The folding-process mechanism 35 is also provided with an advancement mechanism 35*b* that is equipped with, for example, a motor and that causes the folder knife 35*a* to advance toward the load surface of the compiling member 31 from the back surface thereof.

The saddle-stitch bookbinding functional unit 30 is also provided with a nipping roller 36 constituted of a pair of rollers that nip the sheet bundle for which the folding process by the folder knife 35*a* has commenced, and a pair of pressing members 37 that press against a fold section of the sheet bundle that has passed through the nipping roller 36.

A section where the pair of pressing members 37 and a driving mechanism 81 (which will be described later) that drives the pair of pressing members 37 are provided may be regarded as a sheet processing apparatus that performs a pressing process on the fold section.

Furthermore, in this exemplary embodiment, an output roller 38 that outputs the sheet bundle that has been bookbound into a booklet and a booklet load section 45 onto which the sheet bundle transported by the output roller 38 is loaded are provided downstream of the pair of pressing members 37.

Moreover, the driving mechanism 81 that drives the pair of pressing members 37 and a sheet sensor 92 that detects each sheet S transported to the compiling member 31 by the transport roller 39 are also provided.

Configuration of Folding-Process Mechanism 35 and Vicinity Thereof

Figure 4:
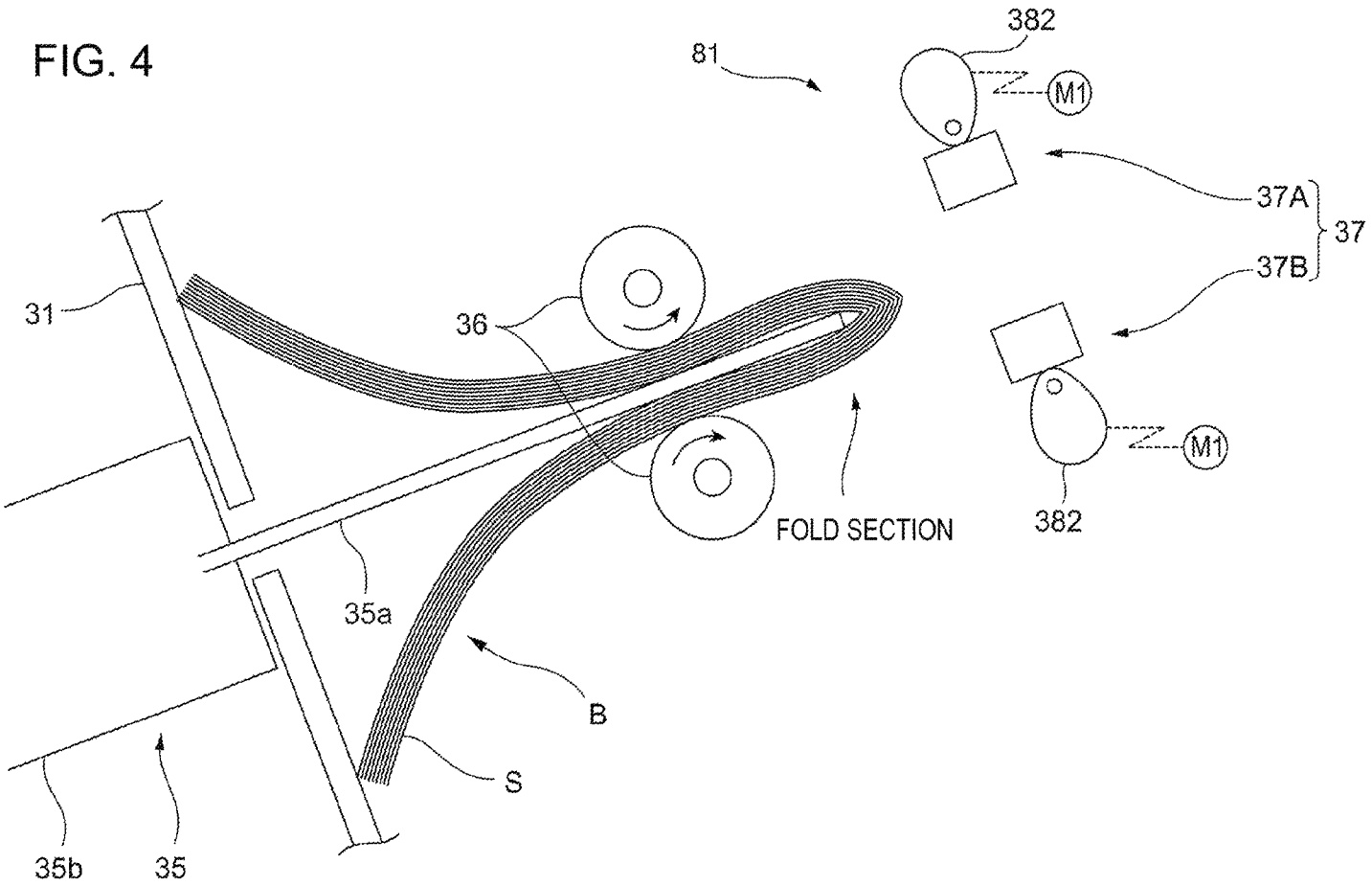
FIG. 4 illustrates the configuration of a folding-process mechanism and its vicinity.

FIG. 4 illustrates the configuration of the folding-process mechanism 35 and its vicinity.

As described above, in this exemplary embodiment, the folding-process mechanism 35 that performs a folding process on a sheet bundle B that has undergone a binding process is provided. This folding-process mechanism 35 is provided with the folder knife 35*a* and the advancement mechanism 35*b* that causes the folder knife 35*a* to advance to the sheet bundle B.

In this exemplary embodiment, the folder knife 35*a* advances until an edge of the folder knife 35*a* reaches the nipping roller 36. Thus, a fold line is formed in the sheet bundle B, and this fold line (fold section) is pressed from opposite sides by the nipping roller 36.

In the sheet stacking stage on the compiling member 31, the saddle-stitching stage by the stapler 82 (see FIG. 3), or the sheet transport stage after the saddle-stitching process, the folder knife 35*a* is located behind the compiling member 31. Thus, interference between the sheets S and the folder knife 35*a* may be prevented.

Furthermore, in this exemplary embodiment, the pair of pressing members 37 that nip and press against the fold section of the sheet bundle B is provided downstream of the nipping roller 36. The pair of pressing members 37 is provided with a first pressing member 37A extending in a direction orthogonal to the plane of the drawing and a second pressing member 37B similarly extending in the direction orthogonal to the plane of the drawing.

Furthermore, the driving mechanism 81 that functions as a part of an advancing-receding unit that causes the pair of pressing members 37 to advance to and recede from the fold section is provided. The driving mechanism 81 is controlled by the sheet processing controller 7.

The driving mechanism 81 is provided with a spring (not shown) that biases the first pressing member 37A in a direction away from the second pressing member 37B, a cam 382 that presses the first pressing member 37A toward the second pressing member 37B, and a first motor M1 that rotates the cam 382. Likewise, the second pressing member 37B is also provided with a spring, a cam 382, and a first motor M1.

Figure 5:
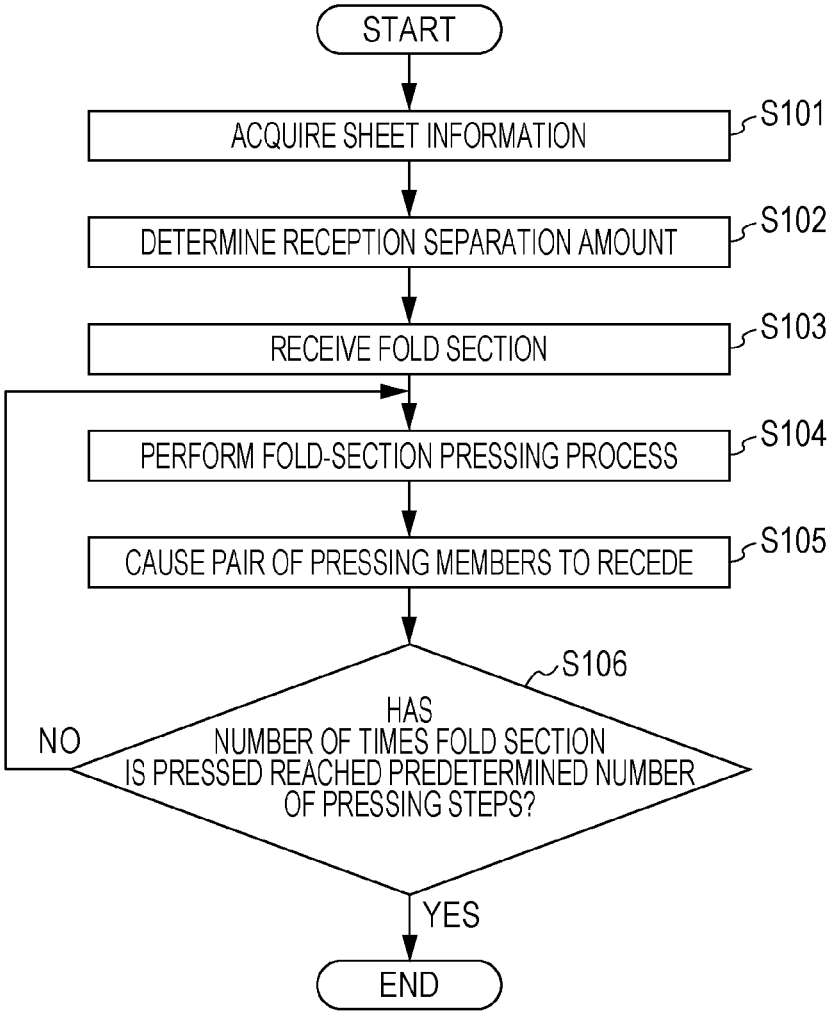
FIG. 5 is a flowchart illustrating the flow of a fold-section pressing process performed by a pair of pressing members.

FIG. 5 is a flowchart illustrating the flow of a fold-section pressing process performed by the pair of pressing members 37. This pressing process is executed by the sheet processing controller 7.

In step S101, the sheet processing controller 7 acquires information related to sheets S (i.e., a sheet bundle B), on which a pressing process is to be performed, from the controller 14 (see FIG. 1) provided in the image forming apparatus 1.

Specifically, the sheet processing controller 7 first acquires information related to, for example, the number of sheets S constituting the sheet bundle B, the size thereof, and the basis weight thereof. In this exemplary embodiment, the controller 14 acquires the information related to, for example, the number of sheets S constituting the sheet bundle B, the size thereof, and the basis weight thereof based on job information obtained from the user. These pieces of information are transmitted to the sheet processing controller 7 via a communication line (not shown). Consequently, the sheet processing controller 7 acquires the information related to the sheets S (i.e., the sheet bundle B).

Subsequently, in step S102, the sheet processing controller 7 determines a reception separation amount based on the information acquired in step S101.

A reception separation amount refers to an amount by which the first pressing member 37A and the second pressing member 37B are separated from each other (i.e., a separation distance) when the fold section of the sheet bundle B is to be received between the first pressing member 37A and the second pressing member 37B.

Then, in step S103, the sheet processing controller 7 performs a fold-section receiving process.

Specifically, the sheet processing controller 7 separates the first pressing member 37A and the second pressing member 37B from each other by the determined reception separation amount and waits until the fold section is moved to the area between the first pressing member 37A and the second pressing member 37B.

Subsequently, in step S104, the sheet processing controller 7 controls the driving mechanism 81 so as to perform a fold-section pressing process by using the pair of pressing members 37.

Specifically, the sheet processing controller 7 controls the driving mechanism 81 so as to cause one of the pressing members included in the pair of pressing members 37 to advance to the other pressing member (i.e., cause the two pressing members included in the pair of pressing members 37 to move toward each other), thereby pressing the pair of pressing members 37 against the fold section.

When driving the pair of pressing members 37, the two pressing members included in the pair of pressing members 37 may both be driven, or only one of the pressing members may be driven.

Subsequently, in step S105, the sheet processing controller 7 causes the pair of pressing members 37 to recede from the fold section. In this exemplary embodiment, the sheet processing controller 7 causes the pair of pressing members 37 to recede from the fold section such that the separation amount between the pair of pressing members 37 after the pair of pressing members 37 has receded becomes equal to a predetermined separation amount.

In this specification, the separation amount between the pair of pressing members 37 after the pair of pressing members 37 has receded will be referred to as "post-receding separation amount" hereinafter.

Then, in step S106, the sheet processing controller 7 determines whether or not the number of times the fold section is pressed has reached a predetermined number of pressing steps.

The sheet processing controller 7 counts the number of times the fold section is pressed and compares this counted number with the predetermined number of pressing steps so as to determine whether or not the number of pressing steps has reached the predetermined number of pressing steps. If the number of times the fold section is pressed has not reached the predetermined number of pressing steps, step S104 and onward are performed again. If the number of times the fold section is pressed has reached the predetermined number of pressing steps, the process ends.

Figure 6B:
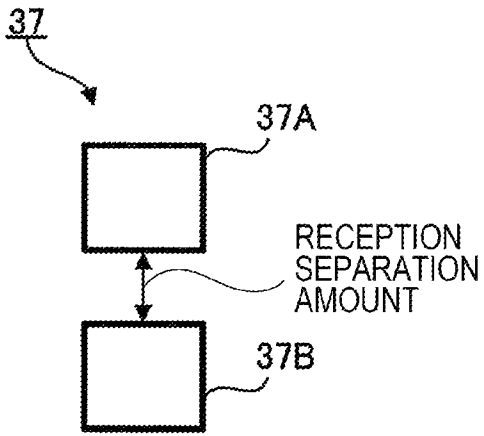
FIGS. 6A and 6B illustrate a reception separation amount.
Figure 6A:
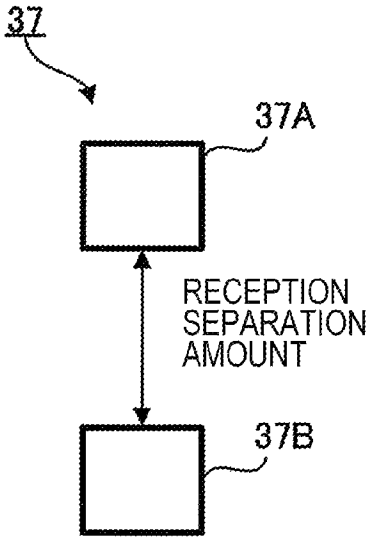

FIGS. 6A and 6B illustrate the reception separation amount.

As described above, in this exemplary embodiment, the information related to, for example, the number of sheets S constituting the sheet bundle B, the size thereof, and the basis weight thereof is acquired, and the reception separation amount is determined based on this information.

FIG. 6A illustrates a reception separation amount when performing a pressing process on the fold section of a sheet bundle B constituted of twenty A3-size sheets S. FIG. 6B illustrates a reception separation amount when performing a pressing process on the fold section of a sheet bundle B constituted of five A4-size sheets S. In this exemplary embodiment, the reception separation amount is increased with increasing thickness of the fold section caused by a larger number of sheets S.

Accordingly, in this exemplary embodiment, the reception separation amount is varied in accordance with the thickness of the fold section. Specifically, the reception separation amount is increased with increasing thickness of the fold section, and the reception separation amount is reduced with decreasing thickness of the fold section.

More specifically, in this exemplary embodiment, a threshold value related to the thickness of the fold section is set in advance, and if the thickness of the fold section is smaller than a predetermined thickness, the reception separation amount is reduced, as compared with a case where the thickness of the fold section is larger than the predetermined thickness.

When causing the pair of pressing members 37 to advance to the fold section, the moving distance of the pair of pressing members 37 becomes smaller if the pair of pressing members 37 is positioned closer to the fold section, so that the fold-section pressing process may be completed within a shorter period of time.

In other words, in the process according to this exemplary embodiment, the pair of pressing members 37 moves toward the fold section when the thickness of the fold section is small, so that the processing efficiency may be enhanced, as compared with a case where the pair of pressing members 37 does not move toward the fold section in this manner.

FIGS. 7A to 7E illustrate a series of steps from when the sheet bundle B is received to when the pressing process performed on the sheet bundle B is completed.

Figures 7A, 7B, 7C, 7D, 7E:
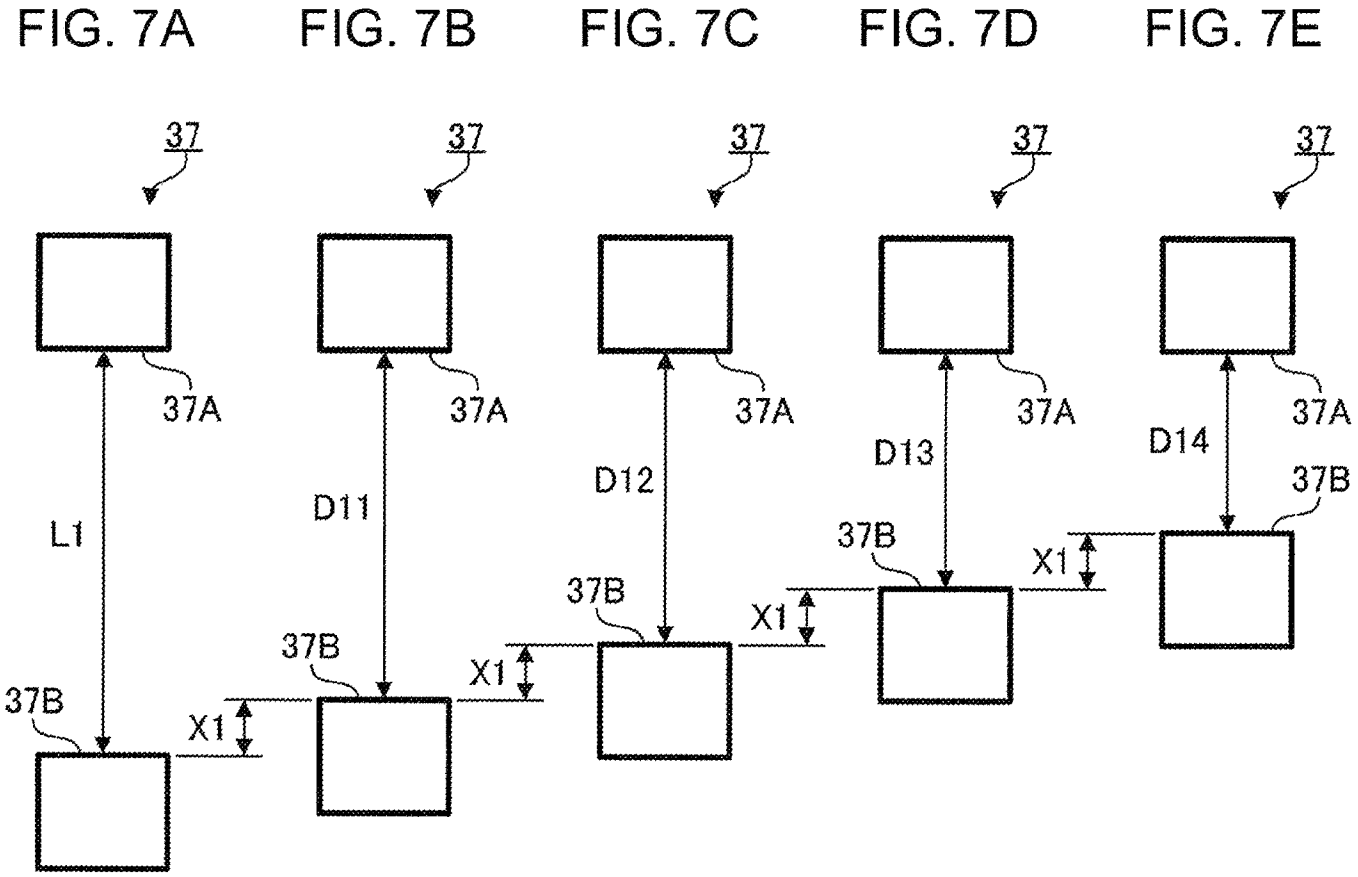
FIGS. 7A to 7E illustrate a series of steps from when a sheet bundle is received to when the pressing process performed on the sheet bundle is completed.

In this exemplary embodiment, the sheet bundle B is first received in a state shown in FIG. 7A. In this state shown in FIG. 7A, the reception separation amount (i.e., the separation distance) is set to a reception separation amount L1.

Subsequently, the pair of pressing members 37 is caused to advance to the fold section so as to perform a first pressing step on the fold section. In other words, the pair of pressing members 37 is pressed against the fold section. After this first pressing step, the pair of pressing members 37 is caused to recede from the fold section.

FIG. 7B illustrates a state of the pair of pressing members 37 after the first pressing step (i.e., a state after the pair of pressing members 37 has receded from the fold section). As shown in FIGS. 7A and 7B, in this exemplary embodiment, a post-receding separation amount (i.e., a separation distance) D11 is smaller than the aforementioned reception separation amount L1.

Subsequently, the pair of pressing members 37 is caused to advance to the fold section again so as to perform a second pressing step on the fold section. After the second pressing step, the pair of pressing members 37 is caused to recede from the fold section.

FIG. 7C illustrates a state of the pair of pressing members 37 after the second pressing step. After the second pressing step, the post-receding separation amount becomes a post-receding separation amount D12, which is smaller than the aforementioned post-receding separation amount D11.

Subsequently, in this exemplary embodiment, third and fourth pressing steps are performed.

As shown in FIGS. 7D and 7E, the post-receding separation amounts upon completion of the third and fourth pressing steps are a post-receding separation amount D13 (<post-receding separation amount D12) and a post-receding separation amount D14 (<post-receding separation amount D13), respectively.

Accordingly, in this exemplary embodiment, the post-receding separation amount is reduced every time a pressing step is performed on the fold section (i.e., every time the pair of pressing members 37 is pressed against the fold section).

Figure 8:
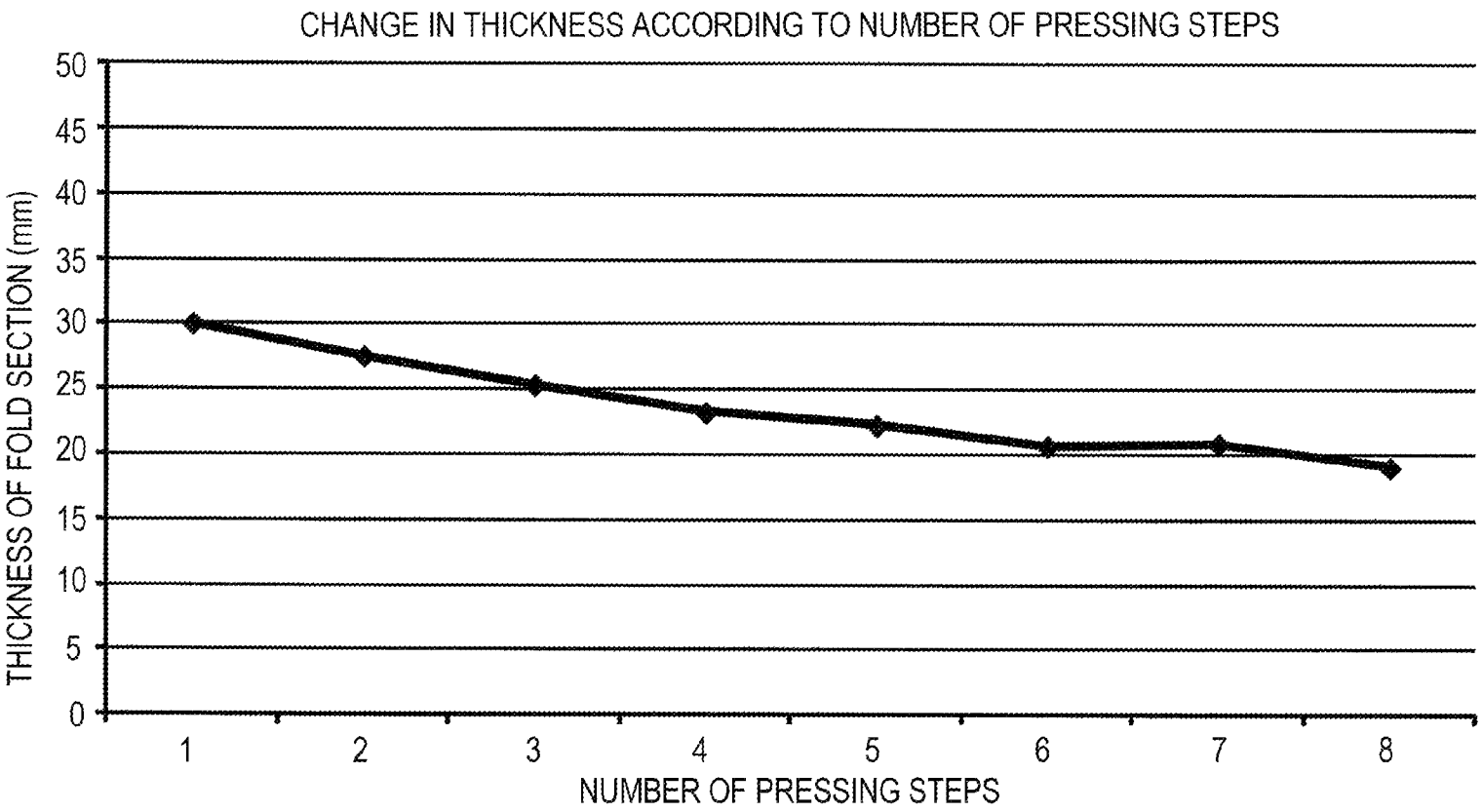
FIG. 8 illustrates an example of the relationship between the number of times a fold section is pressed and the thickness of the fold section.

FIG. 8 illustrates an example of the relationship between the number of times the fold section is pressed and the thickness of the fold section.

As shown in FIG. 8, the thickness of the fold section decreases with increasing number of times the fold section is pressed.

As shown in FIGS. 7A to 7E, in this exemplary embodiment, the post-receding separation amount is reduced in accordance with the number of pressing steps, instead of setting the post-receding separation amount to a fixed value regardless of the number of pressing steps. Thus, the pair of pressing members 37 is positioned closer to the fold section so that the moving distance of the pair of pressing members 37 is reduced, thereby achieving a pressing process with increased efficiency.

In the process shown in FIGS. 7A to 7E, the post-receding separation amount is reduced every time the pair of pressing members 37 is pressed against the fold section. When reducing the post-receding separation amount, a predetermined value X1 is subtracted from one previous post-receding separation amount.

In other words, in the process shown in FIGS. 7A to 7E, every time the pair of pressing members 37 is pressed against the fold section, X1 is subtracted from one previous post-receding separation amount so as to determine a subsequent post-receding separation amount.

Figure 9A:
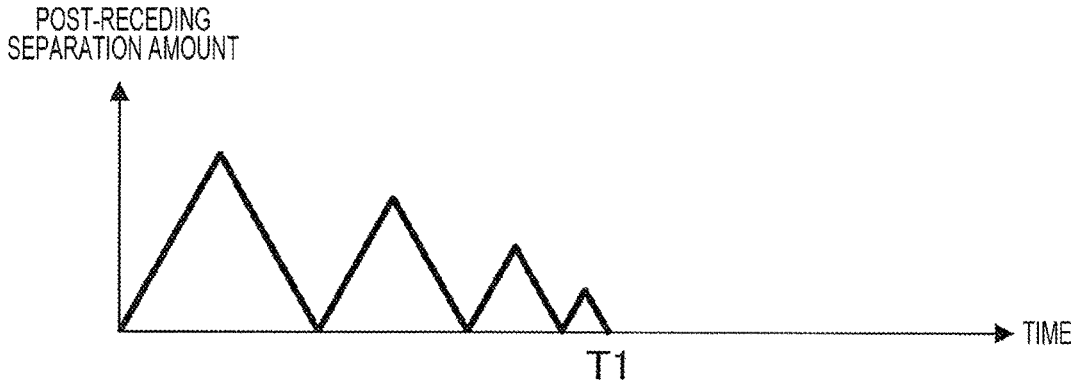
FIGS. 9A and 9B illustrate the process according to this exemplary embodiment and a process according to a comparative example.
Figure 9B:
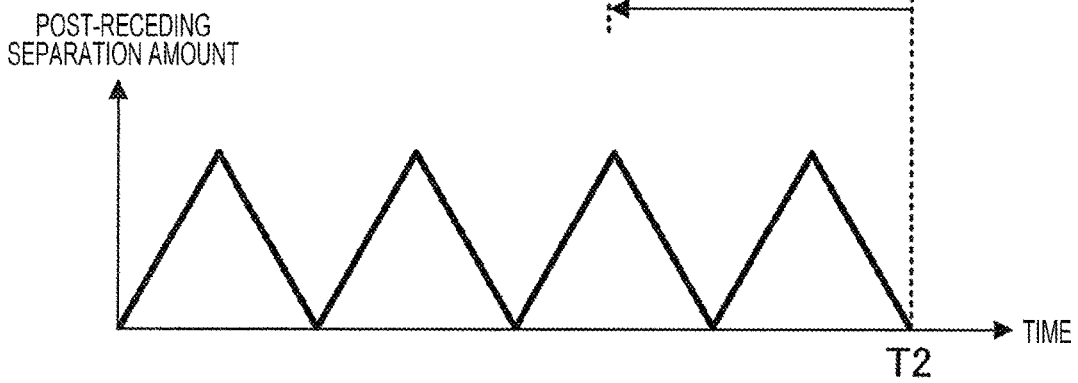

FIGS. 9A and 9B illustrate the process according to this exemplary embodiment and a process according to a comparative example.

Specifically, FIG. 9A illustrates the process according to this exemplary embodiment, whereas FIG. 9B illustrates the process according to the comparative example. Each of FIGS. 9A and 9B does not show the reception separation amount but only shows the post-receding separation amount.

As shown in FIG. 9A, in this exemplary embodiment, the post-receding separation amount is reduced every time a pressing step is performed. In this exemplary embodiment, when time T1 elapses from the start of the process, the process ends.

In contrast, as shown in FIG. 9B, in the comparative example, the post-receding separation amount does not change. In this case, the process ends when time T2 elapses, which is longer than the aforementioned time T1.

FIGS. 10A to 10E illustrate another processing example.

Figures 10A, 10B, 10C, 10D, 10E:
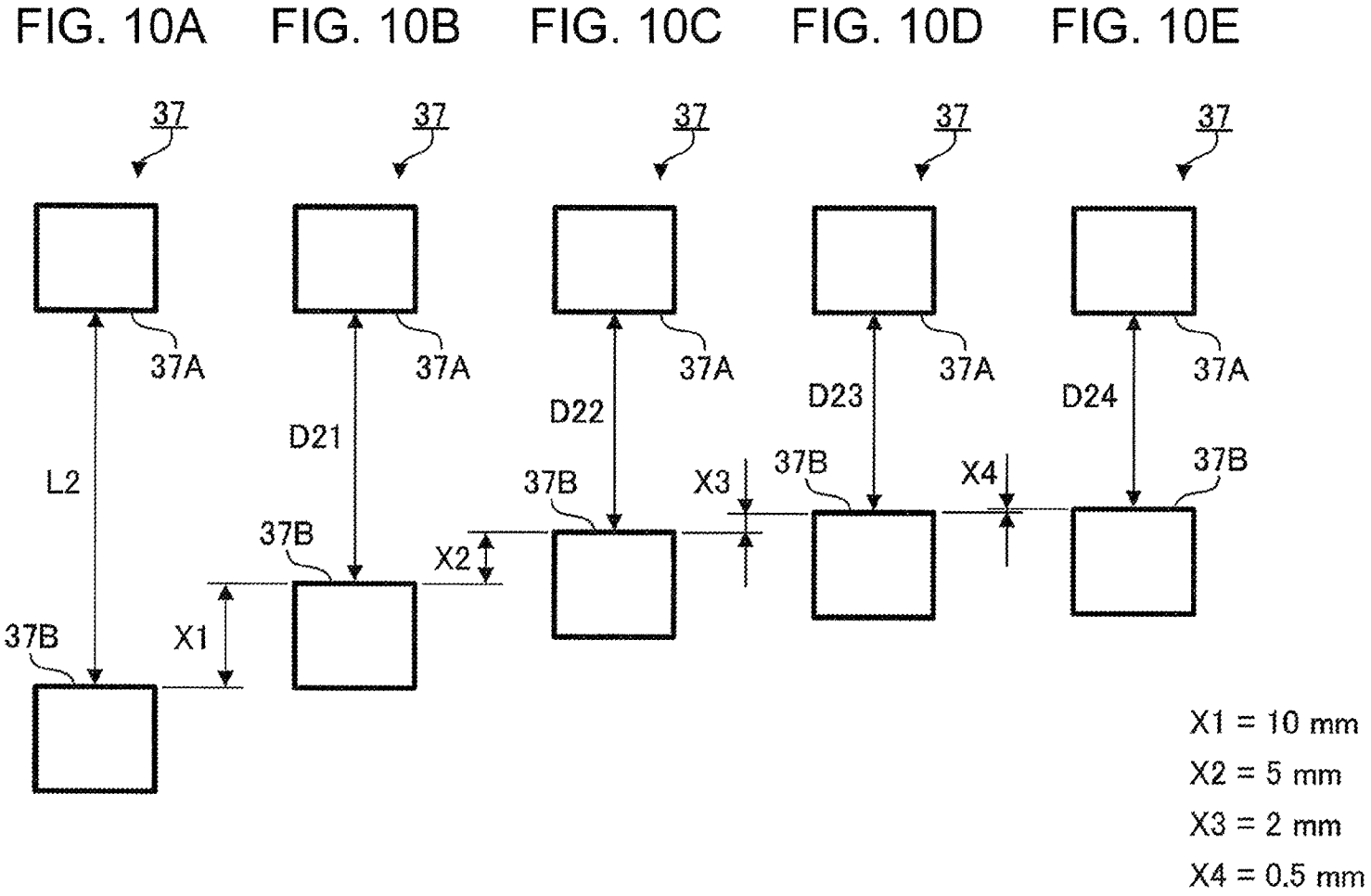
FIGS. 10A to 10E illustrate another processing example.

In this processing example, a sheet bundle is first received in a state shown in FIG. 10A. In this state shown in FIG. 10A, the reception separation amount (i.e., the separation distance) is set to a reception separation amount L2.

Subsequently, similar to the above description, the pair of pressing members 37 is caused to advance to the fold section so as to perform a first pressing step on the fold section. After this first pressing step, the pair of pressing members 37 is caused to recede from the fold section.

FIG. 10B illustrates a state of the pair of pressing members 37 after the first pressing step (i.e., a state after the pair of pressing members 37 has receded from the fold section). Similar to the above description, after the first pressing step, the post-receding separation amount (i.e., the separation distance) becomes a post-receding separation amount D21, which is smaller than the reception separation amount L2.

Subsequently, similar to the process shown in FIGS. 7A to 7E, the second, third, and fourth pressing steps are performed. The post-receding separation amounts upon completion of the second, third, and fourth pressing steps are a post-receding separation amount D22 (<post-receding separation amount D21), a post-receding separation amount D23 (<post-receding separation amount D22), and a post-receding separation amount D24 (<post-receding separation amount D23), respectively.

In this process, the post-receding separation amount is reduced every time the pair of pressing members 37 is pressed against the fold section, so that the processing efficiency may be enhanced, as compared with a case where the post-receding separation amount is not reduced.

In this processing example, a predetermined value X is subtracted from one previous post-receding separation amount, but this value X is not fixed. In this exemplary embodiment, this value X is reduced every time the pair of pressing members 37 is pressed against the fold section.

More specifically, the post-receding separation amount D21 after the first pressing step is a value obtained by subtracting X1 (e.g., 10 mm) from the reception separation amount L2, and the post-receding separation amount D22 after the second pressing step is a value obtained by subtracting X2 (e.g., 5 mm) (<X1) from the post-receding separation amount D21 after the first pressing step.

Furthermore, the post-receding separation amount D23 after the third pressing step is a value obtained by subtracting X3 (e.g., 2 mm) (<X2) from the post-receding separation amount D22 after the second pressing step. Moreover, the post-receding separation amount D24 after the fourth pressing step is a value obtained by subtracting X4 (e.g., 0.5 mm) (<X3) from the post-receding separation amount D23 after the third pressing step.

In the processes described above (i.e., the processes shown in FIGS. 7A to 7E and FIGS. 10A to 10E), the post-receding separation amount is set to be smaller than the reception separation amount upon completion of the first pressing step. Alternatively, the timing at which the post-receding separation amount is set to be smaller than the reception separation amount is not limited to the time point at which the first pressing step is completed and may be set to the time point at which the second pressing step or onward is completed.

Specifically, for example, when the first pressing step and the second pressing step are completed, the post-receding separation amount may be not reduced (i.e., the post-receding separation amount may be equal to the reception separation amount), and the post-receding separation amount may be set to be smaller than the reception separation amount when the third pressing step and onward are completed.

FIGS. 11A to 11E illustrate another example of the fold-section pressing process.

Figure 11A:
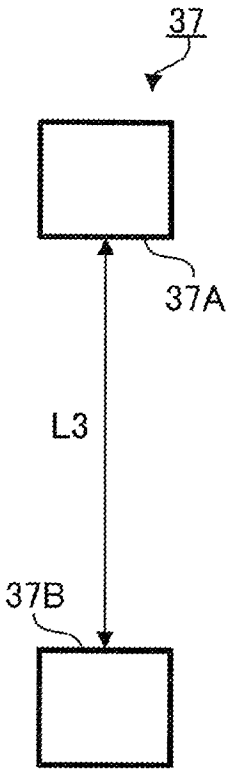
FIGS. 11A to 11E illustrate another example of the fold-section pressing process.

In this process, the sheet bundle B is first received in a state shown in FIG. 11A. In this state shown in FIG. 11A, the reception separation amount is set to a reception separation amount L3.

Subsequently, the pair of pressing members 37 is caused to advance to the fold section so as to perform a first pressing step on the fold section. After this first pressing step, the pair of pressing members 37 is caused to recede from the fold section.

Figure 11B:
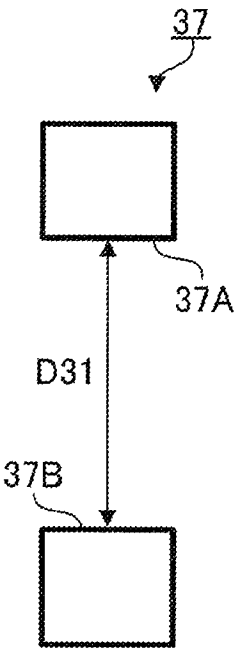
Figure 11C:
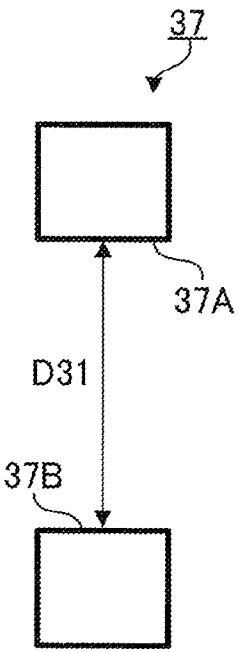
Figure 11D:
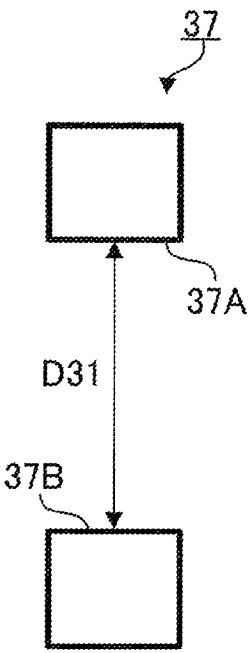
Figure 11E:
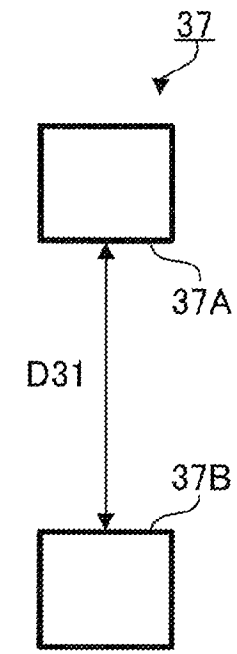

FIG. 11B illustrates a state of the pair of pressing members 37 after the first pressing step (i.e., a state after the pair of pressing members 37 has receded from the fold section). After this first pressing step, the post-receding separation amount becomes a post-receding separation amount D31, which is smaller than the aforementioned reception separation amount L3.

Subsequently, similar to the above description, the second, third, and fourth pressing steps are performed. In the processing example shown in FIGS. 11A to 11E, the post-receding separation amount upon completion of each pressing step is the post-receding separation amount D31. In other words, in this processing example, the post-receding separation amount is the same in the repeatedly-performed receding actions. When performing this process, driving control of the pair of pressing members 37 may be simplified, as compared with a case where the post-receding separation amount is varied.

Figure 12:
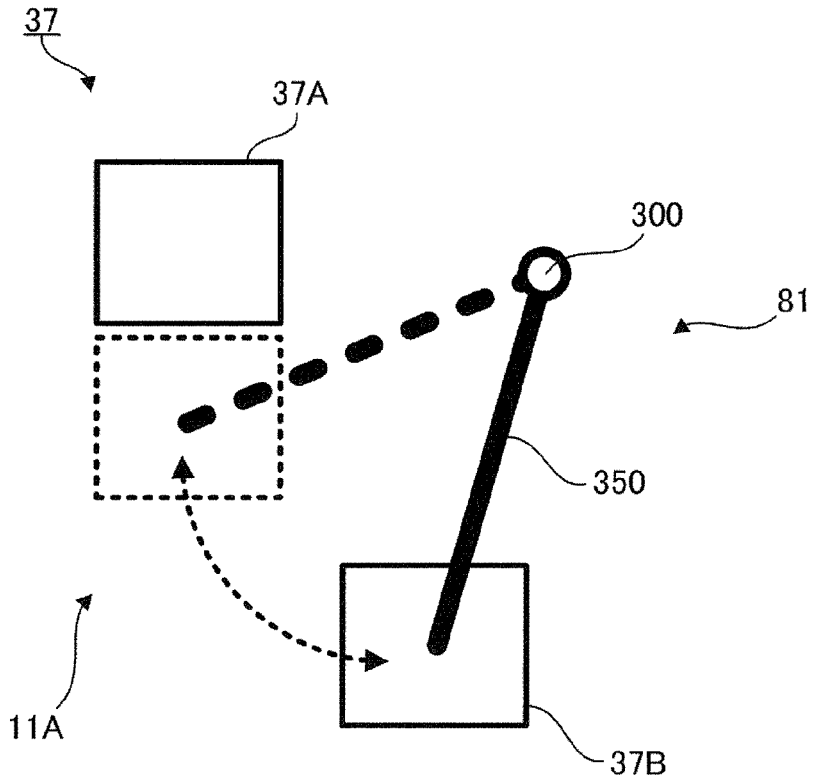
FIG. 12 illustrates another configuration example of a driving mechanism that drives the pair of pressing members.

FIG. 12 illustrates another configuration example of the driving mechanism 81 that drives the pair of pressing members 37.

In this configuration example, the fold-section pressing process is performed by causing the second pressing member 37B to advance to and recede from the first pressing member 37A. Furthermore, in this configuration example, the second pressing member 37B is caused to advance to and recede from the first pressing member 37A by causing the second pressing member 37B to pivot about a predetermined pivot axis.

More specifically, in this configuration example, a connection member 350 that connects a pivot axis 300 and the second pressing member 37B is provided. This connection member 350 is made to pivot (rotate) about the pivot axis 300 by a motor (not shown) and a cam (not shown).

When the connection member 350 pivots, the second pressing member 37B advances to and recedes from the first pressing member 37A, whereby the fold-section pressing process is performed.

In the case where the second pressing member 37B pivots to advance to and recede from the first pressing member 37A in this manner, an available space may be formed in an area facing the first pressing member 37A (i.e., an area denoted by a reference sign 11A). In this case, flexibility in the apparatus layout may be enhanced in the area facing the first pressing member 37A.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet processing apparatus comprising:

a pair of pressing members that nip and press against a fold section of a sheet;

an advancing-receding unit that causes the pair of pressing members to repeatedly press against the fold section by causing at least a first pressing member of the pair of pressing members to advance to and recede from a second pressing member of the pair of pressing members, wherein the advancing-receding unit varies a reception separation amount and a post-receding separation amount from each other and sets the post-receding separation amount to be smaller than the reception separation amount, the reception separation amount being a separation amount by which the two pressing members are separated from each other when the fold section is to be received between the pair of pressing members, the post-receding separation amount being a separation amount by which the two pressing members that have pressed against the fold section are separated from each other after receding from the fold section.

2. The sheet processing apparatus according to claim 1, wherein the advancing-receding unit reduces the post-receding separation amount every time the pair of pressing members is pressed against the fold section.

3. The sheet processing apparatus according to claim 1, wherein the advancing-receding unit performs an advancing and receding operation of the pair of pressing members such that the post-receding separation amount is the same in repeatedly-performed receding actions.

4. The sheet processing apparatus according to claim 1, wherein the first pressing member is caused to advance to and recede from the second pressing member by causing the first pressing member to pivot about a predetermined location.

5. A sheet processing apparatus comprising:

a pair of pressing members that nip and press against a fold section of a sheet;

an advancing-receding unit that causes the pair of pressing members to repeatedly press against the fold section by causing at least a first pressing member of the pair of pressing members to advance to and recede from a second pressing member of the pair of pressing members, wherein the advancing-receding unit varies a separation amount, by which the two pressing members are separated from each other, in accordance with a thickness of the fold section when the fold section is to be received between the pair of pressing members, and wherein if the thickness of the fold section is smaller than a predetermined thickness, the advancing-receding unit reduces the separation amount relative to a case where the thickness of the fold section is larger than the predetermined thickness.

6. The sheet processing apparatus according to claim 5, wherein the advancing-receding unit varies a reception separation amount and a post-receding separation amount from each other and sets the post-receding separation amount to be smaller than the reception separation amount, the reception separation amount being a separation amount by which the two pressing members are separated from each other when the fold section is to be received between the pair of pressing members, the post-receding separation amount being a separation amount by which the two pressing members that have pressed against the fold section are separated from each other after receding from the fold section.

7. An image forming system comprising:

an image forming apparatus that forms an image onto a sheet;

a folding-process mechanism that performs a folding process on the sheet having the image formed thereon by the image forming apparatus; and a sheet processing apparatus that performs a pressing process on a fold section of the sheet that has undergone the folding process performed by the folding-process mechanism, wherein the sheet processing apparatus is the sheet processing apparatus according to claim 1.

* * * * *